US012078462B2

(12) United States Patent
Luxton

(10) Patent No.: US 12,078,462 B2
(45) Date of Patent: Sep. 3, 2024

(54) LOW ENERGY CARTRIDGE

(71) Applicant: KWESST Inc., Ottawa (CA)

(72) Inventor: David Edward Luxton, Merrickville (CA)

(73) Assignee: KWESST INC., Ottawa (CA)

( * ) Notice: Subject to any disclaimer, the term of this patent is extended or adjusted under 35 U.S.C. 154(b) by 0 days.

(21) Appl. No.: 18/377,113

(22) Filed: Oct. 5, 2023

(65) Prior Publication Data

US 2024/0240922 A1 Jul. 18, 2024

Related U.S. Application Data

(63) Continuation of application No. 17/669,420, filed on Feb. 11, 2022, now Pat. No. 11,802,754.

(60) Provisional application No. 63/148,163, filed on Feb. 11, 2021.

(51) Int. Cl.
*F42B 5/02* (2006.01)
*F42B 5/16* (2006.01)

(52) U.S. Cl.
CPC ..... *F42B 5/025* (2013.01); *F42B 5/16* (2013.01)

(58) Field of Classification Search
CPC .... F42B 5/02; F42B 5/16; F42B 5/045; F42B 5/025; F42B 7/10; F42B 8/00; F42B 8/10; F42B 8/02; F42B 10/22; F42B 10/24; F42B 10/26
See application file for complete search history.

(56) References Cited

U.S. PATENT DOCUMENTS 211,665 A * 1/1879 Merriam ..... F42B 5/16 102/443
1,126,294 A * 1/1915 Saffold ..... F41A 21/10 42/77
1,741,901 A * 12/1929 Alden ..... F42B 5/02 102/502
1,777,519 A * 10/1930 Flowers ..... F42B 5/02 42/78
2,414,863 A * 1/1947 Foster ..... F42B 7/10 102/517
4,156,981 A * 6/1979 Lusk ..... F41A 9/73 42/105
6,679,178 B2 * 1/2004 Mihaylov ..... F42B 10/44 102/439

(Continued)

*Primary Examiner* — Jonathan C Weber
(74) *Attorney, Agent, or Firm* — Bennet K. Langlotz; Langlotz Patent & Trademark Works, LLC

(57) ABSTRACT

A low energy cartridge has a case having a sidewall with an interior surface defining a projectile receptacle along a bore axis and having a forward open case mouth, a projectile having an exterior sidewall closely received in the projectile receptacle and defining a rotational axis, a propellant receptacle defined by the case and having a passage communicating with the projectile receptacle, the projectile exterior sidewall being non-circular in cross section across the rotational axis, and the case sidewall interior surface having a rotational engagement feature configured to rotationally engage the non-circular projectile exterior sidewall. The projectile may be slidably received in the projectile receptacle for propulsion from the forward open case mouth. At least one of the projectile and the sidewall interior surface may have a helical surface feature, such that spin is imparted to the projectile upon propulsion from the case.

1 Claim, 8 Drawing Sheets

(56) References Cited

U.S. PATENT DOCUMENTS

| | | | | |
|---|---|---|---|---|
| 7,089,863 | B1 * | 8/2006 | Dindl | F42B 8/14<br>102/524 |
| 2002/0134273 | A1 * | 9/2002 | Mihaylov | F42B 14/04<br>102/439 |

* cited by examiner

LOW ENERGY CARTRIDGE

CROSS-REFERENCE TO RELATED APPLICATION

This application is a Continuation of U.S. patent application Ser. No. 17/669,420 filed on Feb. 11, 2022, entitled "LOW ENERGY CARTRIDGE," which claims the benefit of U.S. Provisional Patent Application No. 63/148,163 filed on Feb. 11, 2021, entitled "LOW ENERGY CARTRIDGE SYSTEM," which are hereby incorporated by reference in their entirety for all that is taught and disclosed therein.

FIELD OF THE INVENTION

The present invention relates to firearms, and more particularly to a low energy cartridge that enables a projectile to be fired at a consistent, controlled non-lethal velocity.

BACKGROUND AND SUMMARY OF THE INVENTION

Various prior art technologies and products attempt to achieve a non-lethal effect when used for different purposes. These include public order, subjugation of dangerous or non-compliant subjects, personal defense, simulated force-on-force training, animal control, and high-action gaming and simulation. However, all existing devices and systems suffer from one or more of the following deficiencies. First, many can be unintentionally lethal. There are thousands of cases of fatalities from the use of blunt impact, chemical, or directed energy weapons such as grenade launchers for crowd control, chemical grenades, tasers, and rubber, plastic, or compressible bullets. Some fatalities have also occurred because of inadvertent loading of live rounds into firing platforms when the user believed they were loading a less-lethal cartridge.

Second, many systems and devices lack sufficient precision to be reliably effective. Chemical agents are susceptible to changes in wind direction and velocity. They can often affect the user, or do not result in funneling the flow of a crowd in the direction intended by the user. Third, many existing systems and devices, such as directed energy weapons, are ineffective in circumstances where the subject has protective clothing, or conceals themself behind cover. These systems also cannot deal with multiple threats simultaneously because they can fire only one or two cartridges before requiring reloading. Fourth, air or gas based systems are inherently unreliable, with seals and "O" rings that can dry out and cause catastrophic malfunctions. They also entail unwieldy logistics support involving large air tanks or compressors. They are also subject to considerably varying muzzle velocity because their performance is affected by ambient temperature, especially in cold weather. Finally, other systems require an adaptor kit to be inserted into a real firearm, resulting in excessive weapon fouling and logistics complexities.

Therefore, a need exists for a new and improved low energy cartridge that enables a projectile to be fired at a consistent, controlled non-lethal velocity. In this regard, the various embodiments of the present invention substantially fulfill at least some of these needs. In this respect, the low energy cartridge according to the present invention substantially departs from the conventional concepts and designs of the prior art, and in doing so provides an apparatus primarily developed for the purpose of enabling a projectile to be fired at a consistent, controlled non-lethal velocity.

The present invention provides an improved low energy cartridge, and overcomes the above-mentioned disadvantages and drawbacks of the prior art. As such, the general purpose of the present invention, which will be described subsequently in greater detail, is to provide an improved low energy cartridge that has all the advantages of the prior art mentioned above.

To attain this, the preferred embodiment of the present invention essentially comprises a case having a sidewall with an interior surface defining a projectile receptacle along a bore axis and having a forward open case mouth, a projectile having an exterior sidewall closely received in the projectile receptacle and defining a rotational axis, a propellant receptacle defined by the case and having a passage communicating with the projectile receptacle, the projectile exterior sidewall being non-circular in cross section across the rotational axis, and the case sidewall interior surface having a rotational engagement feature configured to rotationally engage the non-circular projectile exterior sidewall. The projectile may be slidably received in the projectile receptacle for propulsion from the forward open case mouth. At least one of the projectile and the sidewall interior surface may have a helical surface feature, such that spin is imparted to the projectile upon propulsion from the case. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
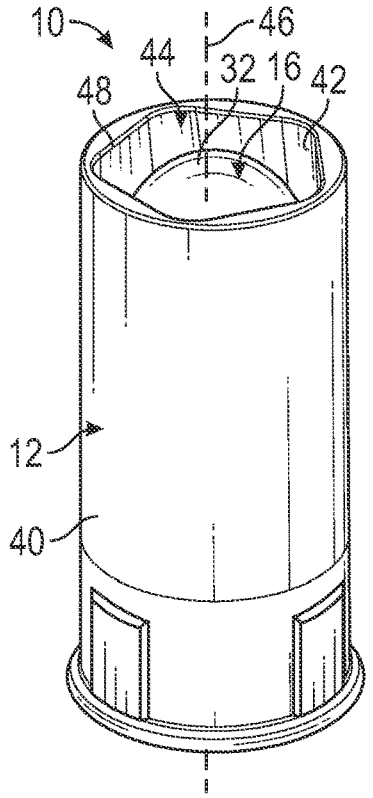
FIG. 1A is a top perspective view of the current embodiment of a low energy cartridge constructed in accordance with the principles of the present invention.
Figure 1B:
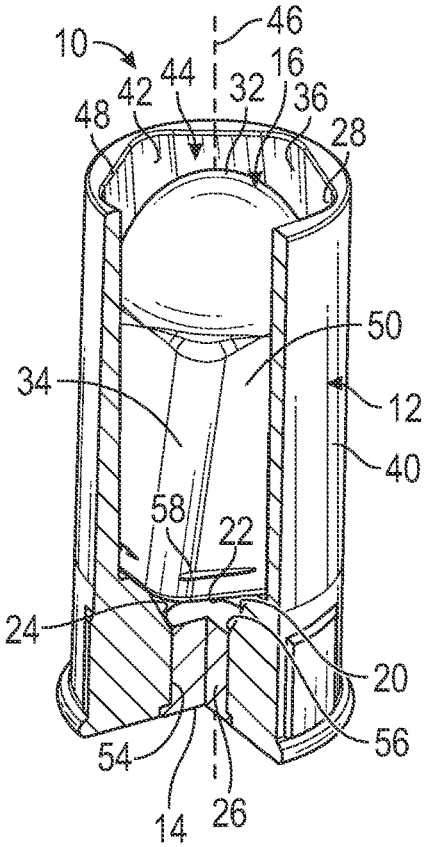
FIG. 1B is a half section view of the low energy cartridge of FIG. 1A.

An embodiment of the low energy cartridge of the present invention is shown and generally designated by the reference numeral 10.

Figure 2A:
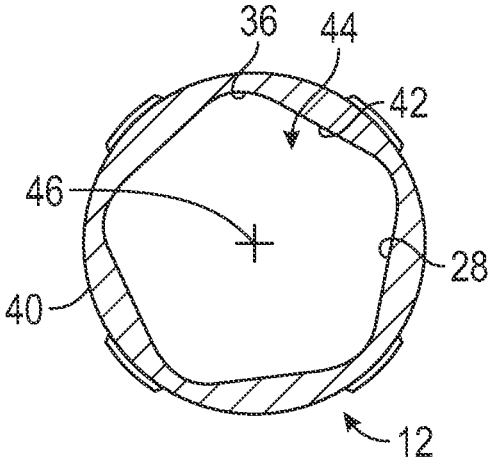
FIG. 2A is top section view of the case of the low energy cartridge of FIG. 1A.
Figure 2B:
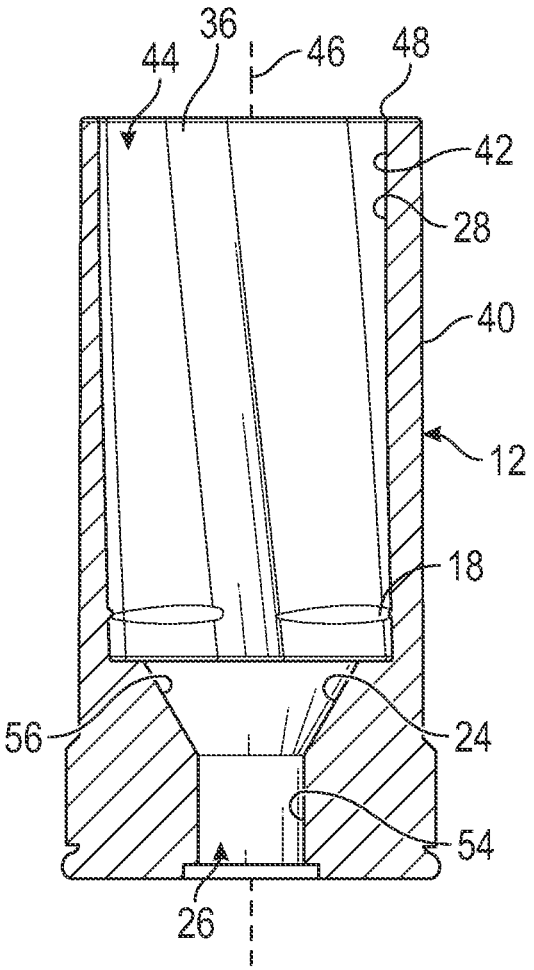
FIG. 2B is a side section view of the case of the low energy cartridge of FIG. 1A.
Figure 2C:
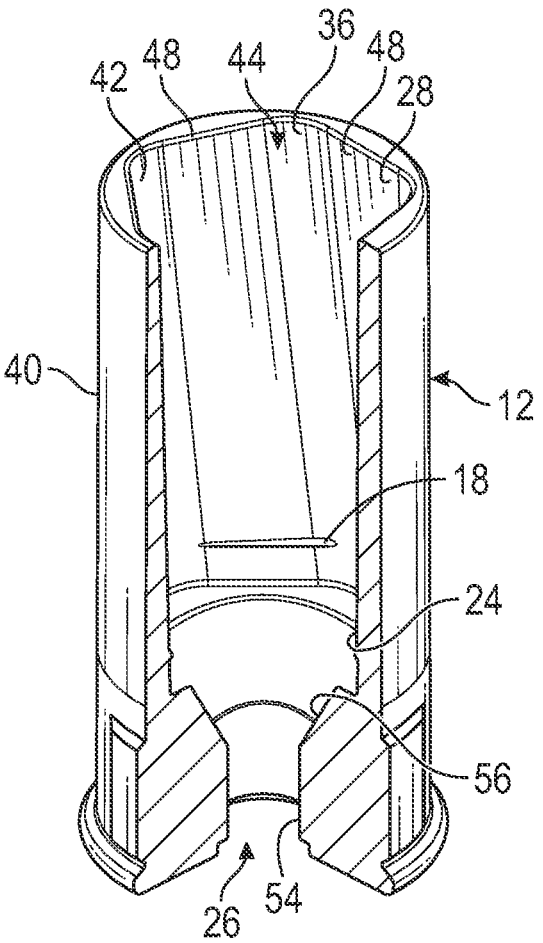
FIG. 2C is a half section view of the case of the low energy cartridge of FIG. 1A.
Figure 3:
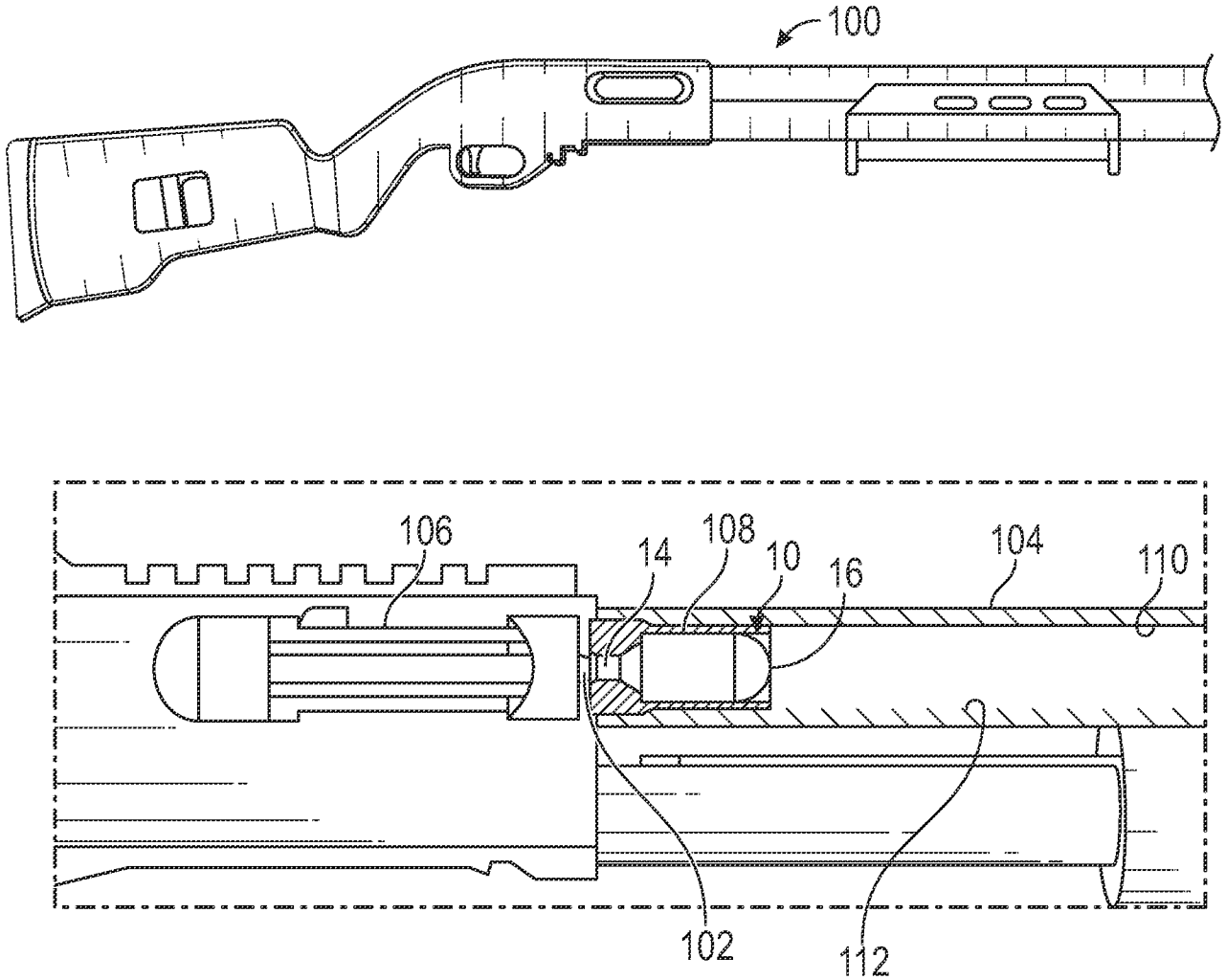
FIG. 3 is a side section view of the low energy cartridge of FIG. 1A loaded in a shotgun.
Figure 4A:
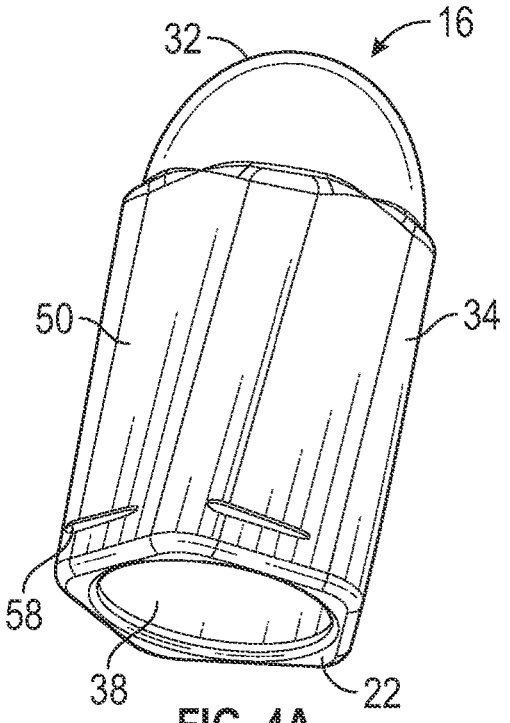
FIG. 4A is a bottom isometric view of the projectile removed from the low energy cartridge of FIG. 1A.
Figure 4B:
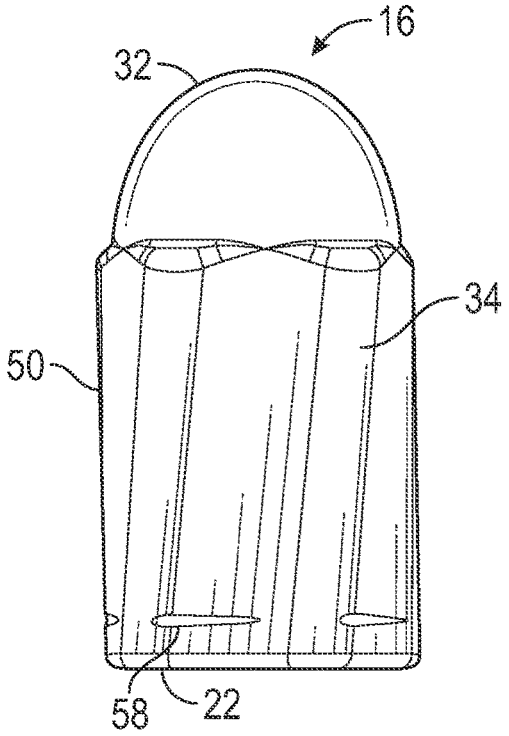
FIG. 4B is side view of the projectile removed from the low energy cartridge of FIG. 1A.
Figure 4C:
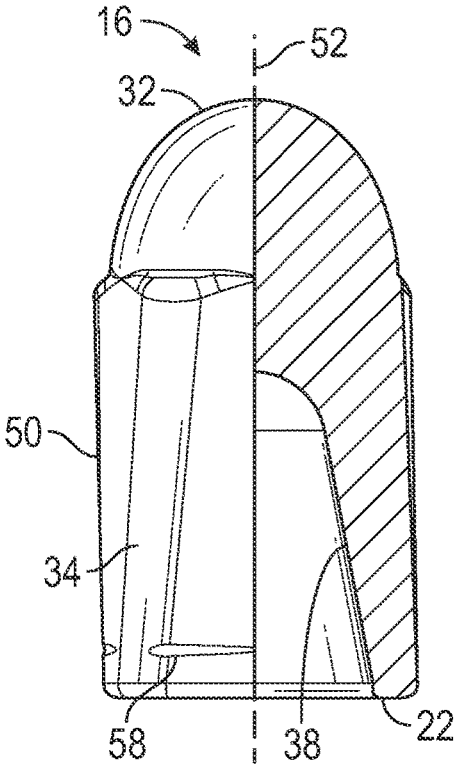
FIG. 4C is a half section view of the projectile removed from the low energy cartridge of FIG. 1A.
Figure 4D:
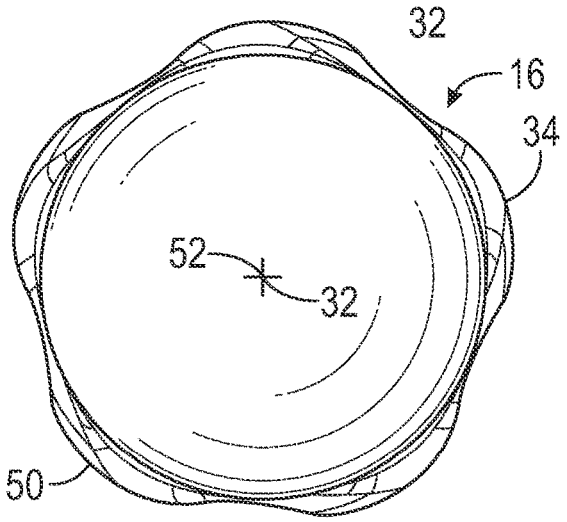
FIG. 4D is a top view of the projectile removed from the low energy cartridge of FIG. 1A.
Figure 4E:
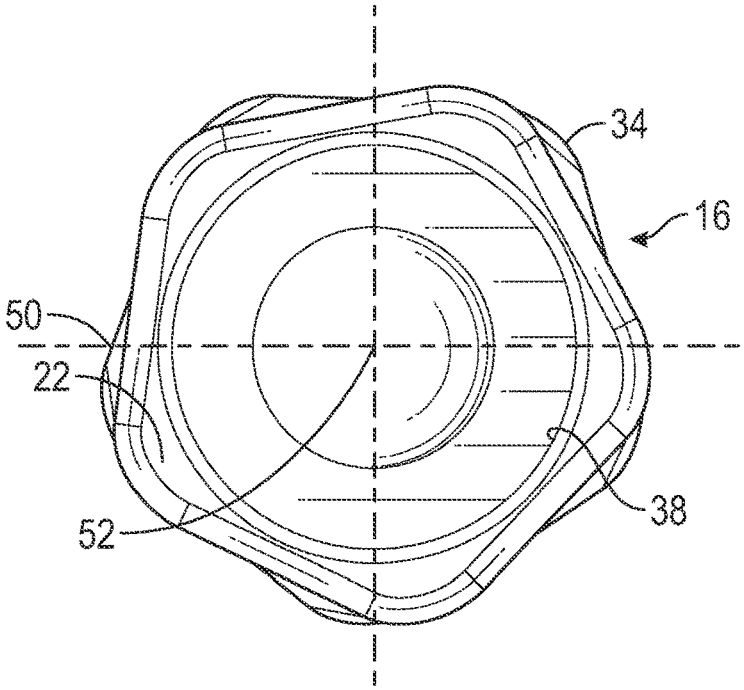
FIG. 4E is a bottom view of the projectile removed from the low energy cartridge of FIG. 1A.

FIGS. 1A & B illustrate the improved low energy cartridge 10 of the present invention, FIGS. 2A-C illustrate the improved case 12 of the present invention, and FIG. 3 illustrates the improved low energy cartridge loaded in a non-reciprocating firing device (a shotgun 100). More particularly, the assembled low energy cartridge has an actuator 14 and a projectile 16, with the projectile inserted and pressed into the case to engage with retention detents 18 in the case. The retention detents accept and retain the projectile, providing a slip fit to prevent the projectile from falling out of the case while still enabling the projectile to launch from the case when the low energy cartridge is detonated. A space 20 between the base 22 of the projectile and the top 24 of the energy dispersion cavity 26 may be buffered with one or more lateral structural baffles (not shown) with perforations between the cavity above the actuator and the base of the projectile that further attenuate and more precisely calibrate the forward force of the actuator detonation. The top of the energy dispersion cavity above the actuator is configured with an outward taper to optimally disperse the energy on detonation of the actuator into the space between the base of the projectile and the top of the energy dispersion cavity. The projectile may be tapered towards the base, and the casing interior 28 oppositely tapered forward, for adjustment of the center of gravity of the projectile for enhanced ballistic stability.

The case 12 for a non-reciprocating firing device having a smoothbore barrel 104, such as the pump-action shotgun 100 shown in FIG. 3, has a polygonal casing interior 28 in the current embodiment that rotationally constrains the projectile 16 to impart spin. The spin of the projectile increases accuracy and range by preventing tumbling in flight. The term "polygonal" refers to flat faces with rounded edges that are twisted to form helical features. Launch of the projectile from the case is powered by an actuator 14, which can be a primer cap with or without propellant, or an electronic actuator. The actuator may optionally be recessed in the base of the case to mate with a custom firing pin 102 (shown in FIG. 3) or plunger on the firing device in order avoid accidental chambering and firing of live ammunition. In FIG. 3, the low energy cartridge 10 is shown chambered in a pump-action device shotgun. The low energy cartridge is held in battery by a custom bolt carrier 106 with the custom firing pin or a plunger or electronic activation device. The pump-action shotgun is designed to accept and activate only the low energy cartridge so that conventional live ammunition cannot be chambered, or if chambered, will not detonate. After detonation of the low energy cartridge, the case is ejected, and the next low energy cartridge loaded by ratcheting the pump action. The barrel defines a chamber 108 configured to closely receive the case. The barrel has a barrel bore 110 forward of the chamber, the barrel bore having a diameter greater than a circumscribing diameter of the projectile such that the projectile does not contact the barrel upon discharge. The barrel has a cylindrical bore surface 112 and is unrifled in the current embodiment.

The case 12 can also be used with a revolver including a cylinder defining a rotation axis and defining a plurality of chambers arranged about the axis, each chamber configured to closely receive the case.

The case 12 can be made of metal or polymer, and can be manufactured by extruding, casting, injection molding, machining, or additive manufacturing (3D printing). The outer width and length of the case can be a non-traditional off-size to prevent accidental chambering of high-power live ammunition in the firing device. The case has a cylindrical exterior sidewall configured to be closely received in a chamber.

FIGS. 4A-E illustrate the projectile 16 removed from the low energy cartridge 10. More particularly, the projectile can be a solid slug or a fillable cap-and-plug for containing a payload of powder, liquid, marking agent, or an irritant substance. The projectile may be frangible, with fracture lines on the nose 32 for dispersing the payload on impact. The remaining length of the projectile has rotational ribs 34 that mate with interior rotational recesses 36 and retention detents 18 of the case 12. At the base 22 of the projectile is a cavity 38 configured for optimal coefficient drag and center of gravity for ballistic stability.

The case 12 has a sidewall 40 with an interior surface 42 defining a projectile receptacle 44 along a bore axis 46 and having a forward open case mouth 48. The projectile 16 has an exterior sidewall 50 closely received in the projectile receptacle and defines a rotational axis 52. A propellant receptacle 54 is defined by the case and has a passage 56 communicating with the projectile receptacle. The projectile exterior sidewall is non-circular in cross-section across the rotational axis in the current embodiment. The interior rotational recesses 36 defined by the case sidewall interior surface are rotational engagement feature configured to rotationally engage the non-circular projectile exterior sidewall.

The projectile 16 is slidably received in the projectile receptacle 44 for propulsion from the forward open case mouth 48. At least one of the projectile and the sidewall interior surface 42 has a helical surface feature, such that spin is imparted to the projectile upon propulsion from the case 12. At least one of the projectile and the sidewall interior surface has a twist shape. The projectile and the sidewall interior surface have polygonal cross-sectional profiles. The projectile and the sidewall interior surface have the same shape and define a consistent limited gap therebetween. The projectile has a first detent feature 58, and the sidewall interior surface including a second detent feature 18 configured to retain the projectile in the case in response to limited extraction forces, and to enable expulsion of the projectile from the case in response to discharge of the propellant/actuator 14. At least one of the first and second detent features includes a plurality of elements arranged in a circle. The first detent feature is relatively proximate to a rear end/base 22 of the projectile, which allows the projectile to be free of the second detent feature for most of the projectile's travel after disengaging the second detent feature early in the projectile's travel.

Figure 5A:
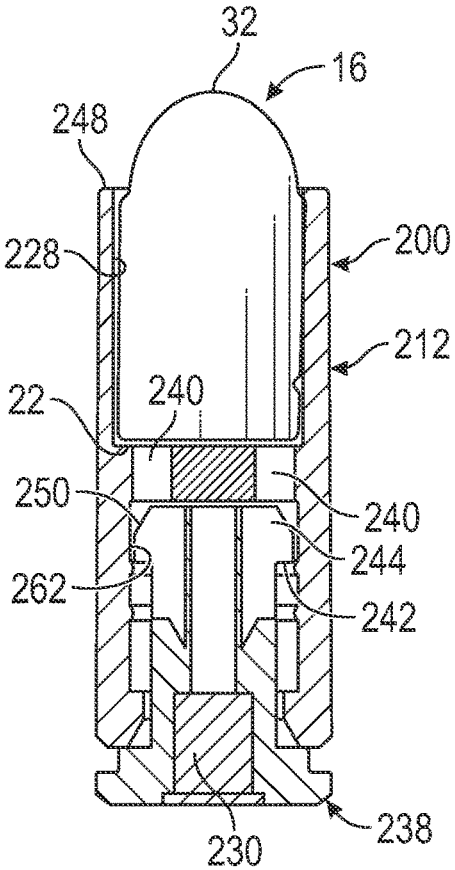
FIG. 5A is a side sectional view of an alternative embodiment of a low energy cartridge constructed in accordance with the principles of the present invention in the undetonated condition.
Figure 5B:
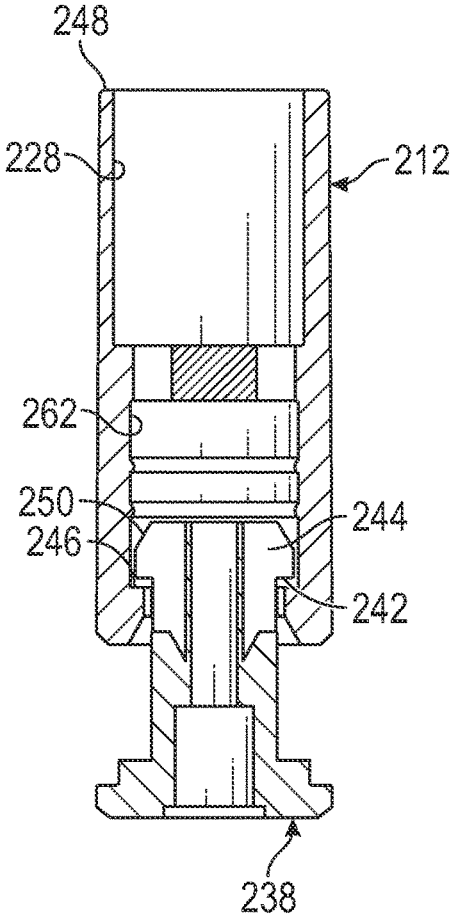
FIG. 5B is a side sectional view of the alternative embodiment of a low energy cartridge of FIG. 5A in the detonated condition.
Figure 6A:
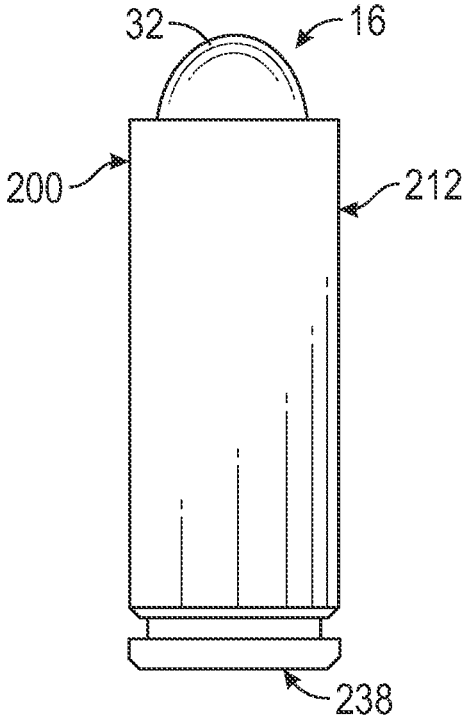
FIG. 6A is a side view of the alternative embodiment of a low energy cartridge of FIG. 5A in the undetonated condition.
Figure 6B:
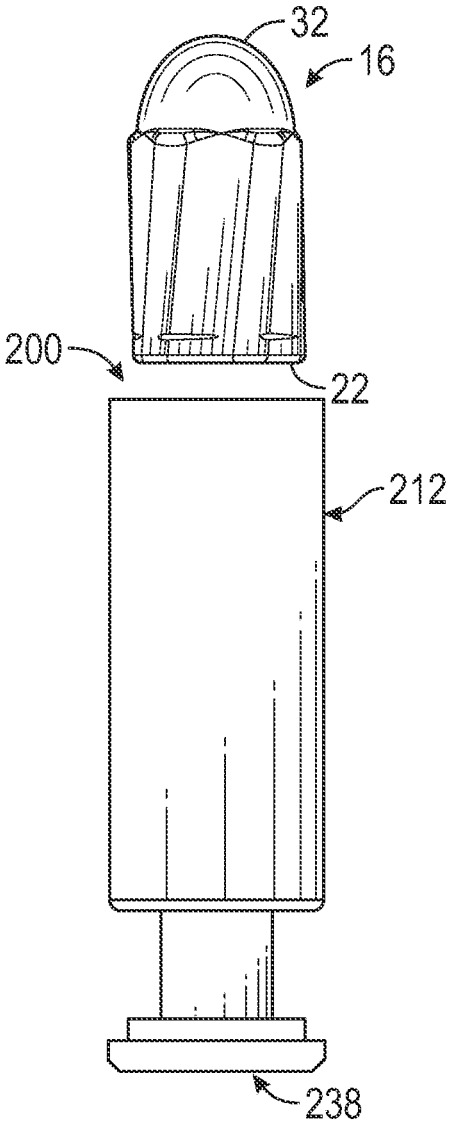
FIG. 6B is a side view of the alternative embodiment of a low energy cartridge of FIG. 5A in the detonated condition.
Figure 7A:
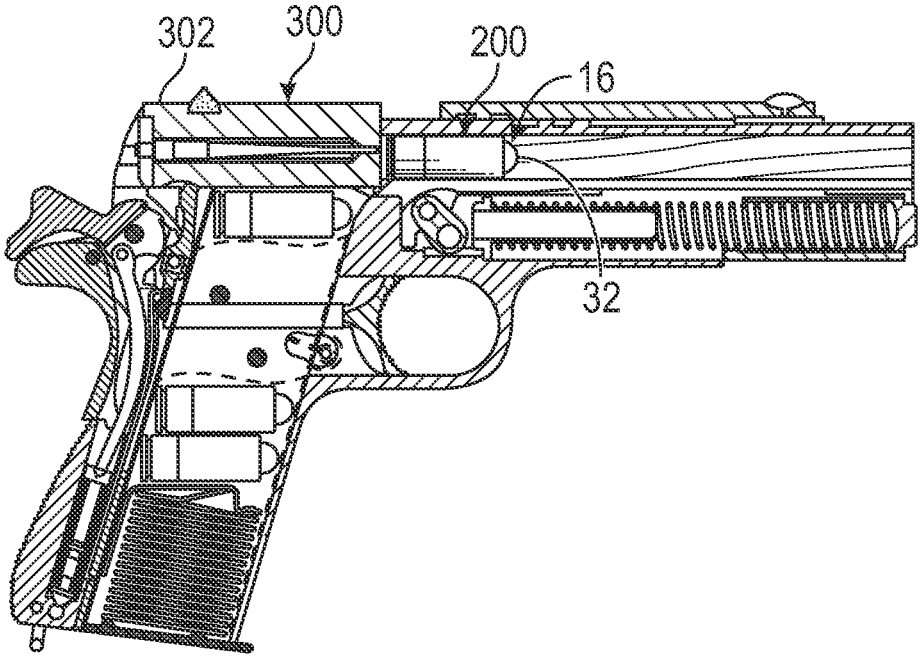
FIG. 7A is a side view of the alternative embodiment of a low energy cartridge of FIG. 5A in the undetonated condition loaded in a pistol.
Figure 7B:
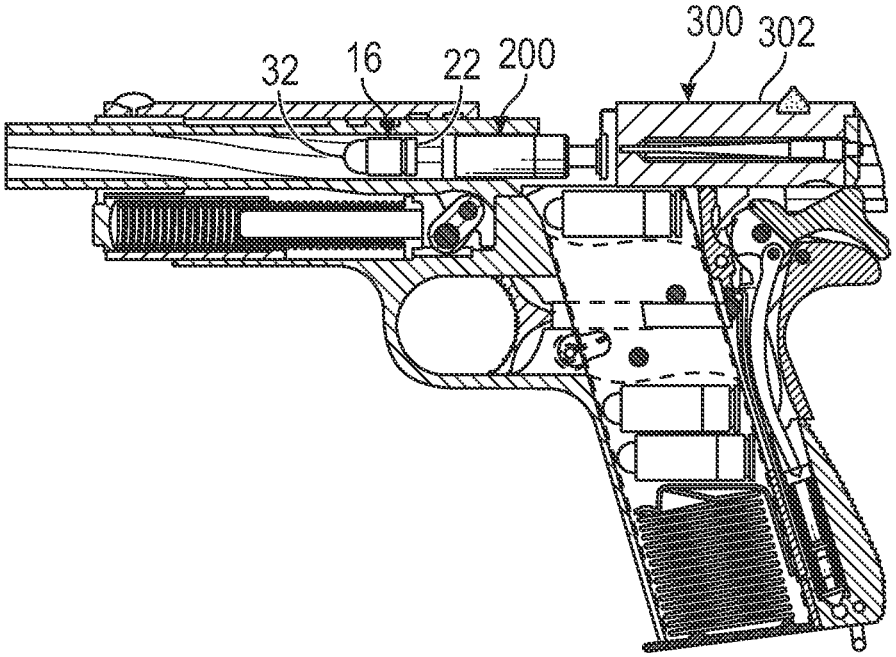
FIG. 7B is a side view of the alternative embodiment of a low energy cartridge of FIG. 5A in the detonated condition loaded in a pistol.
Figure 8E:
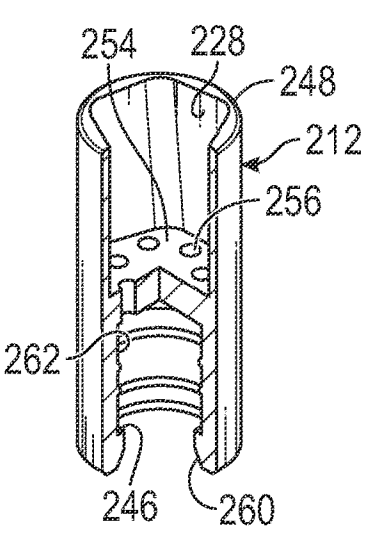
FIG. 8E is a half section isometric view of the case of the alternative embodiment of a low energy cartridge of FIG. 5A.
Figure 8F:
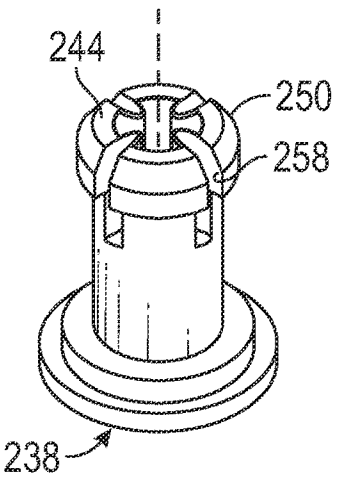
FIG. 8F is an isometric view of the piston of the alternative embodiment of a low energy cartridge of FIG. 5A.
Figure 8C:
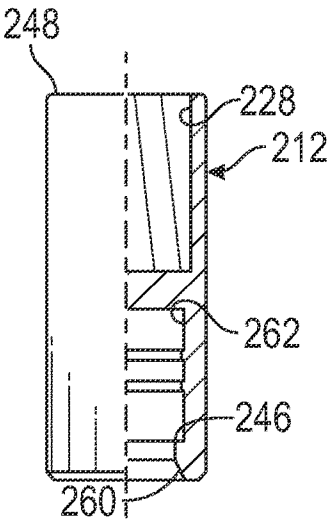
FIG. 8C is a half section view of the case of the alternative embodiment of a low energy cartridge of FIG. 5A.
Figure 8D:
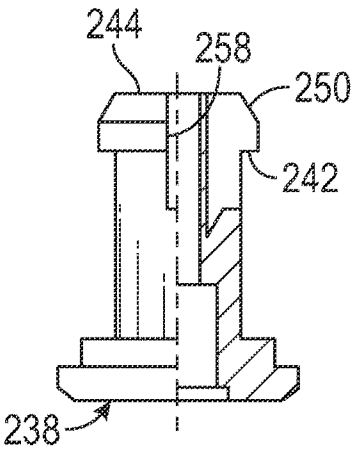
FIG. 8D is a half section view of the piston of the alternative embodiment of a low energy cartridge of FIG. 5A.
Figure 8A:
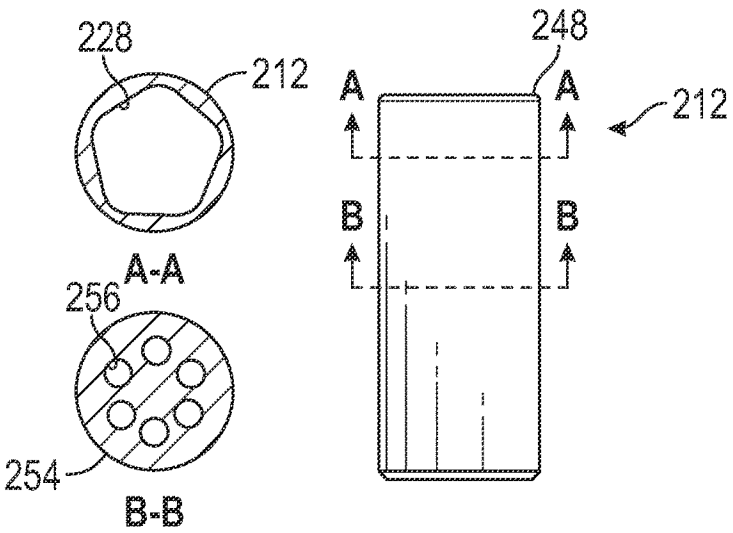
FIG. 8A is a top section view of the case of the alternative embodiment of a low energy cartridge of FIG. 5A.
Figure 8B:
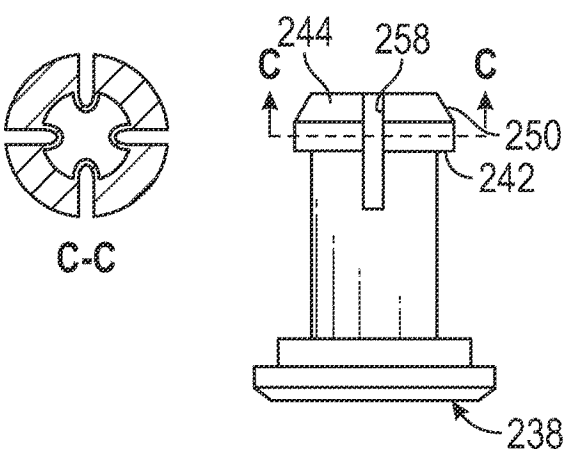
FIG. 8B is a top section view of the piston of the alternative embodiment of a low energy cartridge of FIG. 5A.

FIGS. 5A & 6A show an alternative embodiment of the low energy cartridge 200 in an undetonated condition, FIGS. 5B & 6B show the alternative embodiment of the low energy cartridge in a detonated condition, and FIGS. 7A & 7B show the alternative embodiment of the low energy cartridge chambered in a pistol 300 held in battery by a slide 302 in the unfired position and the fired position. More particularly, the alternative embodiment of the low energy cartridge 200 utilizes the same projectile 16 as the low energy cartridge 10. The low energy cartridge 200 has a case 212 that has a polygonal casing interior 228 in the current embodiment that rotationally constrains the projectile to impart spin. The spin of the projectile increases accuracy and range by preventing tumbling in flight. The term "polygonal" refers to flat faces with rounded edges that are twisted to form helical features. Launch of the projectile from the case is powered by an actuator 230, which can be a primer cap with or without propellant, or an electronic actuator. The base of the case receives a piston 238 containing the actuator that functions as a high-low pressure system upon detonation of the actuator, directing high pressure rearward towards a bolt carrier or slide (shown in FIGS. 7A & B) to cycle the action of a semi-automatic or fully automatic firing device such as the pistol shown in FIGS. 7A & B, and momentarily afterwards directing attenuated low pressure forward towards the projectile that press fits into the case. Prior to detonation of the actuator, the piston is in the un-extended or closed position. Upon detonation of the actuator, the case is supported against pressure by the chamber of the firing platform, resulting in some of the pressure forcing the piston rearward against a bolt assembly or slide to cycle the action of a semi-automatic or automatic firing platform.

FIG. 5A, which depicts the alternative embodiment of the low energy cartridge 200 in an undetonated condition, shows gas ports 240 in the forward section of the case 212 that are sealed by the piston 238 when the piston is inserted fully forward into the rear of the case. Upon detonation, rearward movement of the piston unseals the gas ports. Rearward travel of the piston upon detonation is stopped in a terminal position shown in FIG. 5B by a flange 242 on the bottom of the piston head 244. The flange engages with a protrusion 246 at the base of the interior 228 of the rear section of the case to result in the extended detonated position of the piston shown in FIG. 5B. The outer forward edge of the case shows a chamfer or radius 248 to facilitate feeding of the low energy cartridge into the chamber of the firing device. There can be an optional nodule (not shown) at the forward interior edge of the case for added retention of the projectile 16. The leading forward edge of the piston head also includes a chamfer or radius 250 to facilitate insertion of the piston into the rear case cavity 252.

FIGS. 8A-F show the alternative embodiment of the low energy cartridge 200 with the piston 238 removed from the case 212. The case contains a pressure venting system with one or more solid barriers 254 containing perforations 256 that may be offset from each other to form a baffle. The solid barriers are located between the piston and the projectile 16 to attenuate and calibrate the residual forward energy resulting from detonation of the actuator 230. To enhance manufacturability, there can be slots 258 in the side of the piston head 244 that allow the piston head to be compressed for insertion via an optional guide rib 260 into the rear interior section of the case. Subsequent to insertion, the piston head expands outward and presses against the inward side of the case wall 262 to seal the perforations (if present) and gas ports 240. This seal ensures the high pressure gas resulting from detonation of the actuator 230 first begins pushing the piston rearward forcefully to cycle the firing device's action. This results in the gas decreasing in pressure before a portion of the gas travels through the perforations (if present) and gas ports to launch the projectile from the case. The piston and rear interior section of the cartridge casing can include mated lateral detents (not shown) for more secure retention of the piston inside the rear cartridge section.

The case 212 can be made of metal or polymer, and can be manufactured by extruding, casting, injection molding, machining, or additive manufacturing (3D printing). The outer width and length of the case can be a non-traditional off-size to prevent accidental chambering of high-power live ammunition in the firing device.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While current embodiments of a low energy cartridge have been described in detail, it should be apparent that modifications and variations thereto are possible, all of which fall within the true spirit and scope of the invention. Although pump-action shotguns and pistols have been disclosed, the low energy cartridge is also suitable for use with revolvers, semi-automatic and automatic assault rifles, carbines, machine pistols, and other firing devices designed to not resemble a conventional firearm. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition cartridge comprising:

a case having a sidewall with an interior surface defining a projectile receptacle along a bore axis and having a forward open case mouth;

a projectile having an exterior sidewall closely received in the projectile receptacle and defining a rotational axis;

a propellant receptacle defined by the case and having a passage communicating with the projectile receptacle;

the projectile exterior sidewall being non-circular in cross section across the rotational axis;

the case sidewall interior surface having a rotational engagement feature configured to rotationally engage the non-circular projectile exterior sidewall; and a piston connected to the case and operable to reciprocate with respect to the case.

* * * * *